US008628307B2

(12) United States Patent
Lilie et al.

(10) Patent No.: US 8,628,307 B2
(45) Date of Patent: Jan. 14, 2014

(54) PROXIMITY-SENSOR SUPPORT, A COMPRESSOR, A VALVE PLATE AND A COOLER

(75) Inventors: Dietmar Erich Bernhard Lilie, Joinville-SC (BR); Orlando Starke, Joinville-SC (BR); Alberto Bruno Feldmann, Joinville-SC (BR); Ingwald Wollrath, Joinville-SC (BR); Nerian Fernando Ferreira, Joinville-SC (BR)

(73) Assignee: Empresa Brasileira de Compressores S.A.—Embraco, Joinville-SC (BR)

( * ) Notice: Subject to any disclaimer, the term of this patent is extended or adjusted under 35 U.S.C. 154(b) by 810 days.

(21) Appl. No.: 10/556,254

(22) PCT Filed: Mar. 19, 2004

(86) PCT No.: PCT/BR2004/000037
§ 371 (c)(1),
(2), (4) Date: Feb. 21, 2007

(87) PCT Pub. No.: WO2005/064162
PCT Pub. Date: Jul. 14, 2005

(65) Prior Publication Data

US 2007/0148028 A1 Jun. 28, 2007

(30) Foreign Application Priority Data

May 12, 2003 (BR) ..... 0301329

(51) Int. Cl.
*G01D 21/00* (2006.01)
*F04B 39/10* (2006.01)

(52) U.S. Cl.
USPC ..... 417/417; 73/866.5; 417/569

(58) Field of Classification Search
USPC ..... 417/442, 443, 482, 483, 501, 518, 569, 417/570, 571; 439/527; 73/866.5
See application file for complete search history.

(56) References Cited

U.S. PATENT DOCUMENTS 4,219,740 A * 8/1980 Little ..... 307/116
4,316,145 A * 2/1982 Tann ..... 324/207.26

(Continued)

FOREIGN PATENT DOCUMENTS

DE 40 41 090 6/1992
EP 0 398 012 11/1990

(Continued)

OTHER PUBLICATIONS

International Search Report for PCT/BR2004/000037 completed Jun. 1, 2004.

(Continued)

*Primary Examiner* — Charles Freay
*Assistant Examiner* — Philip Stimpert
(74) *Attorney, Agent, or Firm* — Alston & Bird LLP

(57) ABSTRACT

One describes a support for a proximity sensor to sense the proximity of a piston of a compressor, a compressor proper, a valve plate of a compressor and a cooler provided with these pieces of equipment. One of the objectives of the present invention is achieved by means of a support for a proximity sensor for sensing the proximity of a piston of a compressor comprising a cylinder for the piston, the cylinder being associated to a valve plate, configuring a high-pressure region inside the cylinder and a low-pressure region outside the cylinder, the support comprising a base structure, a first connection end portion and a second connection end portion, the proximity sensor being associated to the high-pressure and the base structure extending as far as the low-pressure region.

22 Claims, 4 Drawing Sheets

(56) References Cited

U.S. PATENT DOCUMENTS

| | | | | |
|---|---|---|---|---|
| 4,385,297 | A * | 5/1983 | Schmitt et al. | 340/870.31 |
| 4,515,516 | A * | 5/1985 | Perrine et al. | 417/38 |
| 4,924,675 | A * | 5/1990 | Higham et al. | 62/6 |
| 5,139,559 | A * | 8/1992 | Kozora | 65/158 |
| 5,514,961 | A * | 5/1996 | Stoll et al. | 324/207.13 |
| 5,845,897 | A * | 12/1998 | Tunkers | 269/32 |
| 2001/0051098 | A1* | 12/2001 | Kenney et al. | 417/410.1 |
| 2002/0014128 | A1* | 2/2002 | Kroll et al. | 73/866.5 |
| 2002/0074994 | A1* | 6/2002 | Blubaugh et al. | 324/207.13 |
| 2002/0176790 | A1* | 11/2002 | Akazawa et al. | 417/417 |

FOREIGN PATENT DOCUMENTS

| | | |
|---|---|---|
| EP | 0 508 823 | 10/1992 |
| FR | 2 342 419 | 9/1977 |
| WO | WO 2004/025120 | 3/2004 |

OTHER PUBLICATIONS

International Preliminary Report on Patentability for PCT/BR2004/000037 completed Jul. 26, 2005.

Written Opinion on the International Searching Authority for PCT/BR2004/000037.

* cited by examiner

PROXIMITY-SENSOR SUPPORT, A COMPRESSOR, A VALVE PLATE AND A COOLER

The present invention relates to a proximity-sensor support of a compressor piston, a compressor proper, a valve plate of a compressor, as well as a cooler provided with such equipment.

DESCRIPTION OF THE PRIOR ART

A compressor is an equipment used in the cooling cycle of coolers and air-conditioning systems in general, and basically has the function of capturing a gas under a given pressure and compressing it, so that it will actuate on said cycle. Basically, one can operate with rotary compressors or else with linear compressors, and in both types it may be necessary to monitor the respective movement.

In particular, in the cases of linear compressors, it is necessary to monitor the respective movement, in order to avoid problems of impacts and noises. As it is known from the prior art, a linear compressor basically comprises a piston axially displaceable in a cylinder. The cylinder, in turn, comprises, at the end of its stroke, suction and discharge valves, which regulate the entry and exit of the gas under pressure into and out of the cylinder.

Since the compression-operation conditions and the feed voltage may vary and cause the piston to be displaced more than necessary and to collide with the valve plate, it is necessary to monitor the piston position.

With a view to prevent this drawback, various solutions haven been proposed, as for instance placing the sensors that detect the piston position along the cylinder stroke or a the end thereof. These sensors are usually positioned in cavities in the cylinder housing, being interconnected by means of wires to electronic monitoring and controlling circuits that are positioned out of the compressor, for example, a cooler on which the compressor is mounted.

The number of wires to be passed from the outside into the compressor housing is considerable large (wires for feeding and sending the sensor signal). For this reason, the passage of said wires from the inside out of the housing has to be hermetically isolated, so that the effectiveness of the compressor will not be impaired.

In addition, the sensor has to be fixed to the cylinder housing in some way, which makes difficult its installation and, consequently, the connection of the wires for feeding and sending the signal. This kind of installation, as well as the sensor with protection against pressures in the high-pressure regions inside the cylinder may be seen in the specification of application PI 0203724-6, which is incorporated herein by reference.

One of the problems resulting from the assembly of any type of sensor on compressors in general lie in the fact that the production line of such equipment is impaired, since the fitter will have to fit the sensor at some point of the compressor, leaving at least one point for a future electric connection to a control circuit. This connection is usually a pair of wires that should later be soldered or connected in some other way, resulting in a complicating factor in the production line, which will become slower and, consequently, more expensive.

OBJECTIVE AND BRIEF DESCRIPTION OF THE INVENTION

One of the objectives of the present invention is to provide a proximity-sensor support of a compression piston, a compressor proper, a valve plate of a compressor, and a cooler provided with such pieces of equipment, by which one can eliminate steps in the production line and which, at the same time, does not impair the tightness of the compressor.

Another objective of the present invention is to provide a proximity-sensor support of a compressor piston, a compressor proper, a valve plate of a compressor, as well as a cooler provided with these pieces of equipment, wherein the electric connector of the sensor support is located outside the compressor housing, thus maximizing its internal volume, which is an advantage looked after by the makers of compressors.

A further objective of the present invention is to provide a sensor support that can enable a worker to have easy access to a production line, and at which one can use simple electric connectors, without the need for soldering processes at the time of manufacturing coolers in general.

In addition, it is a further objective of the present invention to provide a valve plate that will enable one to use a sensor support and makes it feasible to mount such a support without the need to modify the other pieces of the compressor.

One of the above objectives is achieved by means of a proximity-sensor support of a compressor piston, the compressor comprising: a piston cylinder, the cylinder being associated with a valve plate, configuring a high-pressure region inside the cylinder and a low-pressure region outside the cylinder, the valve plate comprising an border associated to the cylinder, the support comprising: a base structure and a first end connection portion, the proximity sensor being associated to the high-pressure region of the valve plate, the first end connection portion being associated to the proximity sensor in the low-pressure region and the base structure extending as far as an electric connector in the low-pressure region, the support further comprising a second end connection portion, the second end connection portion extending, at least in part, beyond the border of the valve plate.

Further, the objectives of the present invention are achieved by means of a compressor comprising a piston positioned in a cylinder, a valve plate associated to the cylinder, configuring a high-pressure region inside the cylinder and a low-pressure region outside the cylinder, the high-pressure region being selectively hermetically isolated from the low-pressure region by means of the vale plate, a cover positioned close to the valve plate, hermetically sealing the high-pressure region from the low-pressure region. The compressor comprises a sensor of proximity of the piston to valve plate, the proximity sensor being associated to the high-pressure region of the plate valve. The support comprises a base structure, the first end connection portion being associated to the proximity sensor in the low-pressure region, and the base structure extending within the cover in the low-pressure region. The compressor may further comprise a valve plate, a border associated to the cylinder, the base structure comprising a second end connection portion extending, at least in part, beyond the border of the valve plate, the cover being positioned close to the valve plate along the border. The base structure being positioned between the cover and the valve plate, the compressor further having a joint positioned between the valve plate and the cover, the base structure being positioned between the cover and the joint.

The objectives of the present invention are further achieved by means of a valve plate for a compressor, the valve plate comprising a guide means for a support of the sensor of proximity of a compressor piston, the guide means being provided on one surface of the valve plate.

The objectives are also achieved by means of a cooler provided with a compressor comprising a piston positioned in a cylinder, a valve plate associated to the cylinder, configuring a high-pressure region inside the cylinder and a low-pressure region outside the cylinder, the compressor comprising a sensor of proximity of the piston to the valve plate. The support comprises the base structure extending from the high-pressure region to the low-pressure region, and the first end connection portion being associated with the valve plate.

BRIEF DESCRIPTION OF THE DRAWINGS

The present will now be described in greater detail with reference to an embodiment represented in the drawings. The figures show.

DETAILED DESCRIPTION OF THE FIGURES

Figure 1:
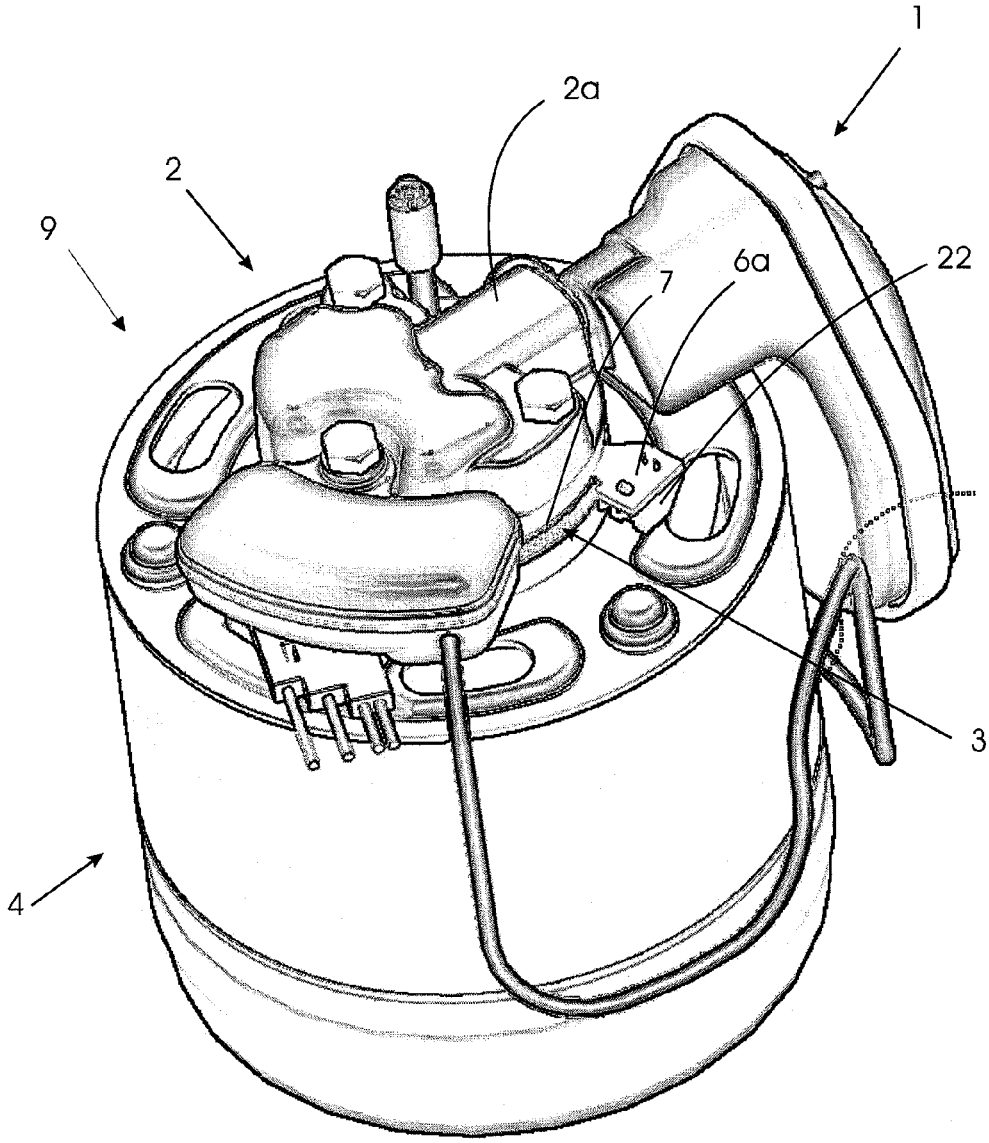
FIG. 1 is a perspective view of a linear compressor comprising a support for the sensor of proximity of the piston, built according to the teachings of the present invention.
Figure 2:
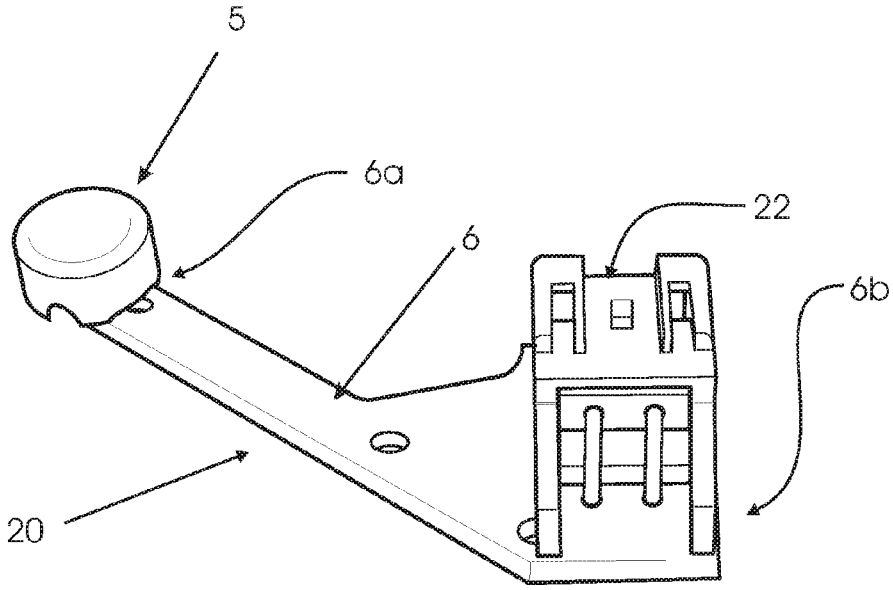
FIG. 2 is a perspective view of the sensor support of the present invention.
Figure 3:
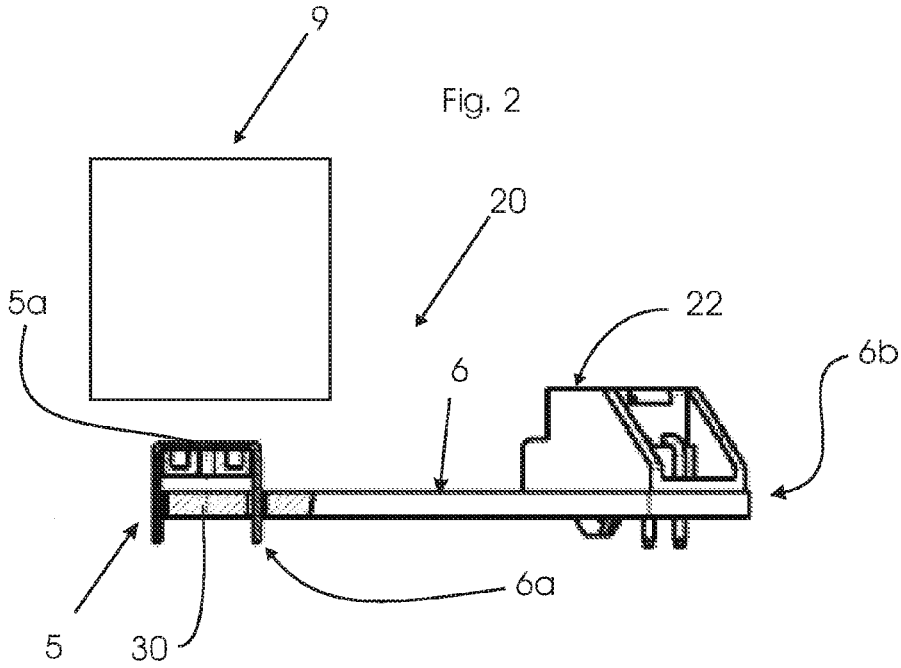
FIG. 3 is a side view of the sensor support illustrated in FIG. 2, showing, in detail, the inside of a sensor.

As can be seen in FIG. 1, a linear compressor 1 comprises a cylinder 2 and an axially displaceable piston 9, which are enveloped by a housing 4. The cylinder 2 comprises a valve plate 3 positioned at the end of its stroke, to control the entry and exit of the fluid to be compressed. Mounted over this, there is a cover 2*a* of the cylinder 2, which, in combination with a joint 7 and the valve plate 3, hermetically seals the compressor 1. The cover 2*a* is positioned close to the cylinder 2, hermetically sealing the compressor 1.

Figure 4:
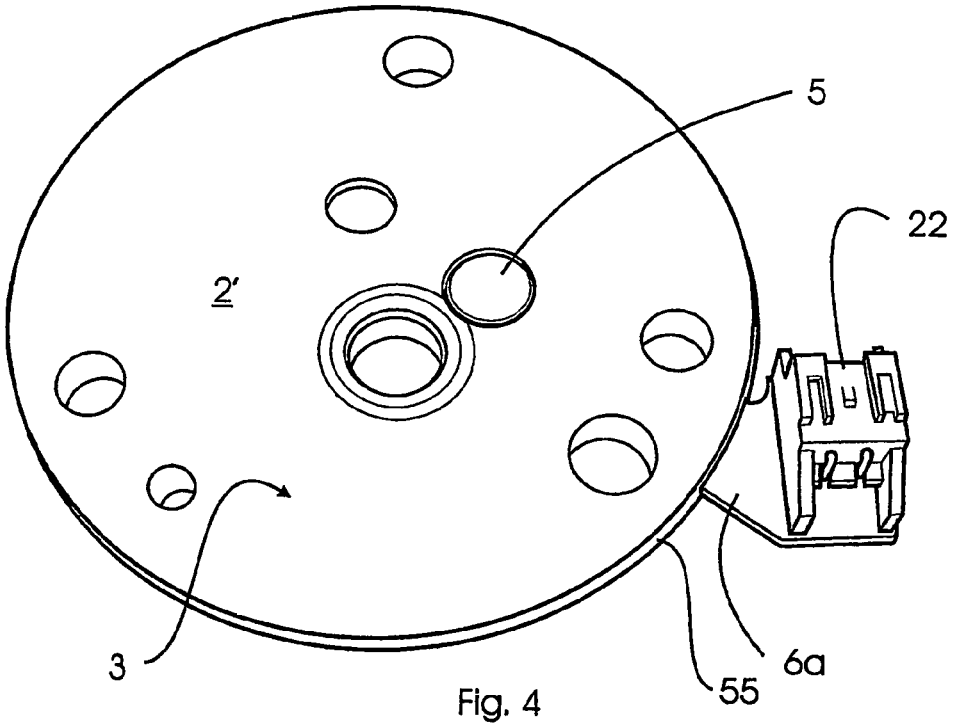
FIG. 4 is a lower perspective view of a valve plate provided with a sensor support according to the present invention.
Figure 5:
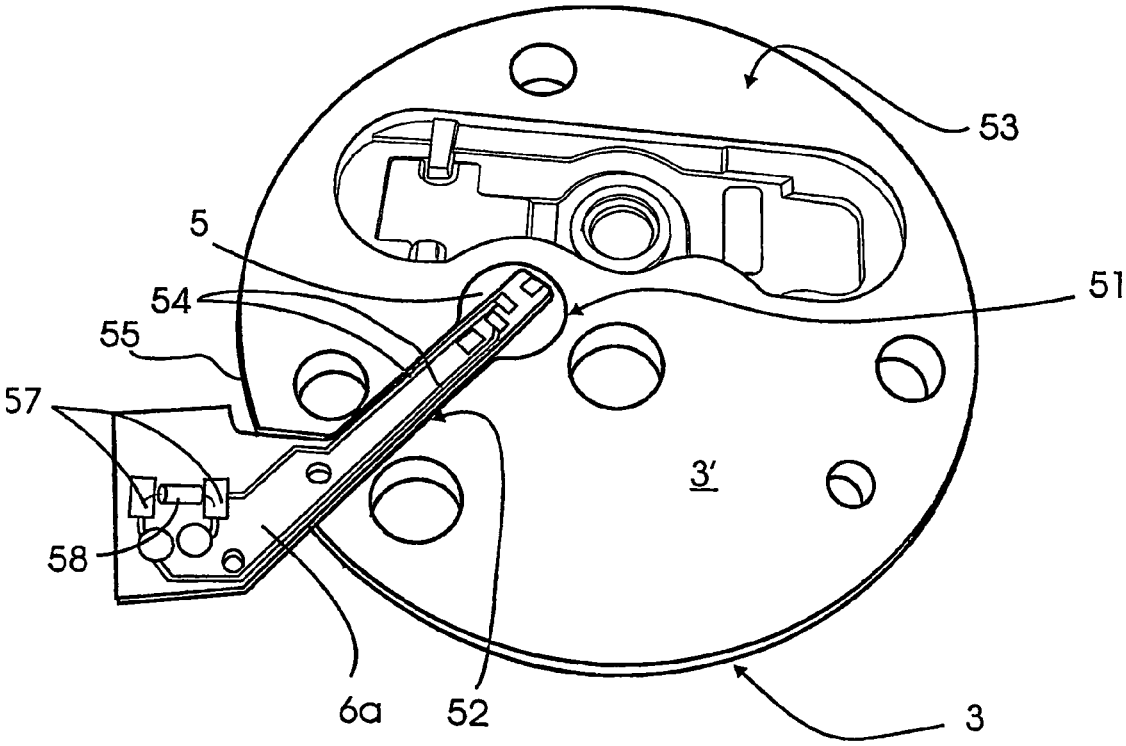
FIG. 5 is an upper view of the valve plate illustrated in FIG. 4.

Further as can be seen in FIGS. 1, 4, and 5, the valve plate 3 comprises a border 55 associated to the cylinder 2, configuring a high-pressure region 2' inside the cylinder 2 and a low-pressure region 3' outside the cylinder 2. The opening and closing of the valves of the compressor 1 results in the high-pressure region 2', which is selectively hermetically isolated from the low-pressure region 3' by means of the valve plate 3, that is to say, the gas to be compressed is now sucked into the cylinder now expelled from this region, according to the axial displacement of the piston 9.

As known from the teachings of document PI 0203724-6, in order to prevent collision of the piston 9, the placement of a proximity sensor 5 close to a through bore 51 in the valve plate 3 is foreseen.

Preferably, one nay use an inductive-type proximity sensor 5 in this type of assembly, the signal being read by this element and led to an external electronic circuit (not shown) that controls the functioning of the compressor 1, by means of a pair of wires according to the teachings of the prior techniques.

As already described, in this form of electric connection the connection wires should come out of the proximity sensor 5 without interfering with the air-tightness of the equipment, the sensor 5 being located inwardly of the cover 2*a* of the compressor 1. Thus, according to a first preferred embodiment, as one of the objectives of the present invention to solve the problem resulting from the mounting of the proximity sensor 5 by wires, a support 20 is provided for the proximity sensor 5.

As can be seen in FIG. 2 to 5, the support 20 comprises a base structure 6, a first end connection portion 6*a* and a second end connection portion 6*b*.

The base structure 6 should be substantially oblong and planar and sufficiently long to extend from the high-pressure region 2' as far as the low-pressure region 3', and so that the first end connection portion 6*a* will be associated with the valve plate 3 and the second end connection portion 6*b* will extend, at least partly, beyond the border 55 of the valve plate 3, so as to facilitate the mounting of an electronic circuit (not shown) that controls the piston 9 position. Optionally, the connector 22 may be positioned within the cover 2*a* within the low-pressure region 3'.

The first end connection portion 6*a* should comprise a support means 30 for the proximity sensor 5, such a support means, for example one or more through bores for connecting and fixing the proximity sensor, fitting projections, electric contacts or the like.

The first end portion 6*a* may be provided with fitting means for a protecting cover 5*a* for a proximity sensor 5, for instance. An embodiment of this type of solution is described in document PI 0203724-6, which brings teachings for mounting a protecting cover for association with an inductive sensor.

The second end connection portion 6*b* should be preferably provided with an electric connector 22 fixed and electrically associated to the base structure 6, so as to facilitate the connection of the proximity sensor 5 at the time of mounting the compressor 1 itself and further at the time of mounting a cooler provided with such a compressor 1.

The second end connection portion 6*b* may further preferably comprise an electric connection 57 for a calibration resistor 58, such a calibration sensor 58 having the function of attenuating the signal generated by the proximity sensor 5, if the latter generates a variability above the expected one. Such a variation may occur, because the circuit and the proximity sensor 5 are usually designed for the generated values to be always higher than desired, and so the calibration resistor 58 has the function of attenuating the signal from the proximity sensor 5 to the desired value, controlling the final variability of the measurement.

With the electric connector 22 positioned on the external side of the compressor 1, the present invention dispenses with the use of several soldering points for electrical connection by means of wires, thus bringing about a maximization in the time of mounting and maintaining the compressor 1, as well as eliminating mounting steps, since, without the need for multiple soldering steps, the assembly line becomes much easier and effective, achieving some of the objectives of the invention.

Further according to the teachings of the first preferred embodiment of the present invention, the base structure 6 is preferably manufactured from a printed-circuit board, since such a substrate meets all the requirements necessary to achieve the objectives of the invention:

the connections by means of loose wires are eliminated, since they are replaced by electric interconnections 54, which are the tracks of the printed circuit itself;

the printed circuit enables one to prepare the interconnections of the proximity sensor 5 itself, in addition to bringing about great flexibility for promoting electric interconnection points with the connector 22 and the calibration resistor 58; and other electric interconnection points may be included without any need for technical implementation;

the material of the printed circuit is a substantially rigid material, which facilitates the handling of the support 20, which, in addition, may be cut in various shapes, according to the needs of the compressor design 1.

Figure 6:
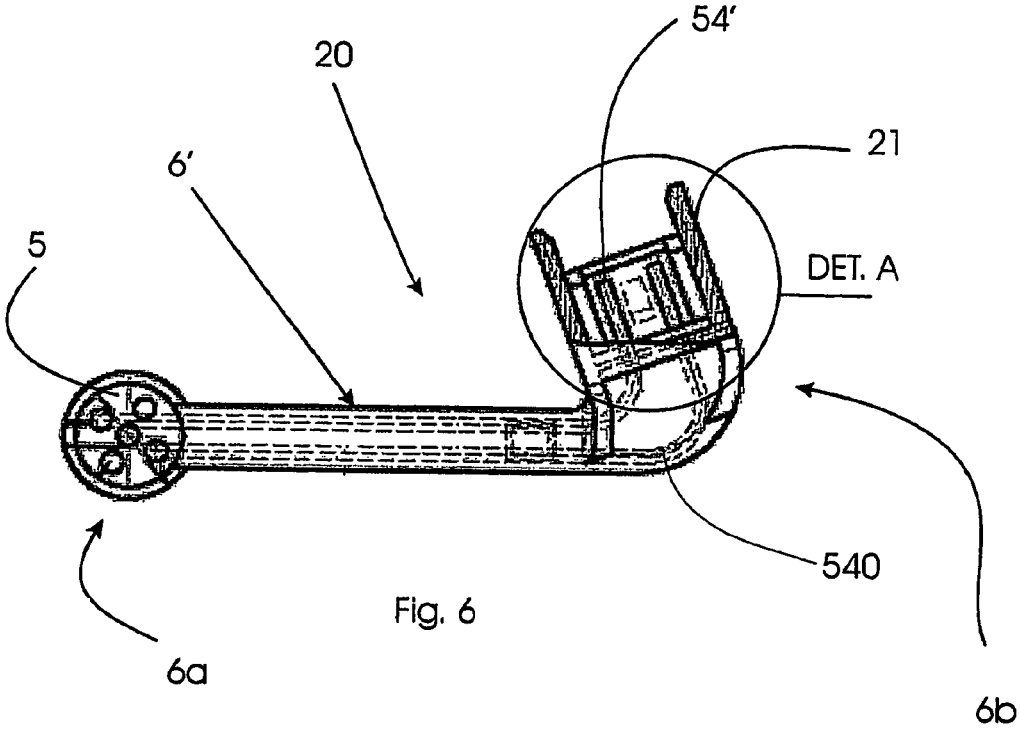
FIG. 6 is a lower view of a second preferred embodiment of the sensor support of the present invention.
Figure 7:
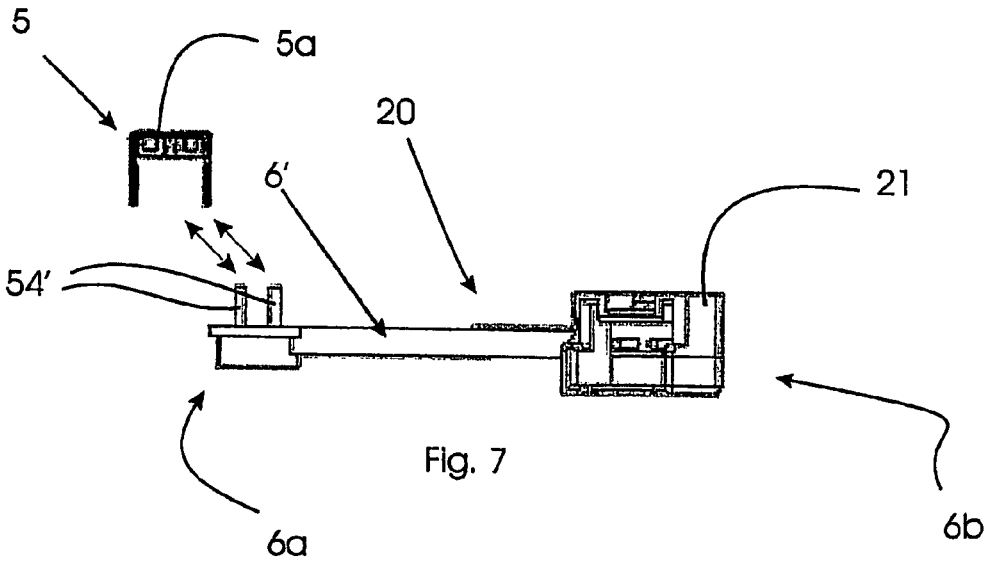
FIG. 7 is a side cross-section view of the second preferred embodiment of the sensor support of the present invention.

According to the teachings of a second preferred embodiment, as can be seen in FIGS. 6 and 7, a base structure 6' manufactured from a printed-circuit board will be replaced by an injected plastic piece or made any other polymer, wherein the conductors are rigid and supported in position by the overinjection itself.

In this second embodiment, the base structure 6' forms a piece integral with the injected connector 21, by injecting a single piece, which eliminates, for example, the step of fixing the connector 22, thus being of more advantageous application on a large scale. In this option, the injected connector 21 is provided at the moment of injecting the piece.

According to this second embodiment, the electric interconnections 54 essentially formed by tracks of the printed circuit will be replaced, in this case, by electric conductors 54, preferably accommodated in guide means 540, which will be obtained by making through grooves along the base structure 6'. These grooves may be closed or open in the surface of the base structure 6'. In case they are closed, the electric conductors 54' should be introduced in said grooves, whereas in the option of being open they should merely be positioned along the base structure 6'.

The electric conductors 54', should preferably be made of a rigid material, so as to shape them in such a way that the respective end projections will be directly applicable as electric connections. In this way, the end projections of the electric conductors 54' close to the connector 21 will be an integral part thereof, as can be seen in FIG. 6 (see detail A), and the end portions close to the proximity sensor 5 may be easily connected to such an element, be it by connection or by soldering.

Moreover, the electric conductors 54' may be provided in any constructive form, for instance, they may have a rectangular, circular, cross-section, be covered with an insulating or non-insulating material, as long as they meet the teachings of the present invention. Preferably, they should be rigid wires, so that they can be shaped as described before.

The costs of obtaining the support 20 of the second preferred embodiment are quite advantageous, since they are made while injecting the piece itself and because they enable one to eliminate the step of mounting the electric connector 22.

The electric connector 21 is provided so as to fit into another terminal of a circuit (not shown) that interprets the signal from the sensor 5. The electric connections are effected directly to the electric conductors 54'.

In the two embodiments, one may apply any type of proximity sensor 5 and the electric connector 22, 21, which may by interchanged according to the needs of the project. Even so, one may benefit from the teachings of the present invention.

Further according to the teachings of the present invention, a valve plate 3 is provided for a compressor 1 comprising a support guide 52 for the support 20, the support guide 52 being provided on a surface 53 of the valve plate 3.

As can be seen in FIGS. 4 and 5, the guide support 52 is preferably constituted by a recess in the surface 53 of the valve plate 3, such a recess being substantially analogous to and covering half the thickness of the structure 6, 6' of the support 20 of proximity sensor 5, which extends from the external end border of the valve plate 3 to the through bore 51 provided for fitting the proximity sensor 5.

In order to seal the system totally, the joint 7 too preferably have a recess for covering the other half of thickness of the structure 6, 6' of the support 20. The recesses of the joint 7 and of the valve plate 3 are aligned in this form of construction.

Thus, according to the teachings of the present invention, one can mount a compressor 1, preferably of the linear type, onto which one mounts the sensor support 20 close to the valve plate 3, achieving a configuration in which the proximity sensor 5 may be accommodated in the through bore 51 and where the base structure 6, 6' is accommodated on the guide support 52 of the valve plate 3 and in the recess provided in the joint 7. Further, the connector 21, 22 remains exposed to enable one to effect an easy connection with an external circuit. The connection is located out of the region of the valve plate 3, occupies a smaller volume inside the compressor 1. This increase in the internal space of the compressor 1 is an advantage that is being constantly looked for by the makes of compressors in general, one of the objectives of the present invention having been achieved.

In addition, this construction guarantees the air-tightness of the compressor 1, since the base structure 6, 6' of the support 20 becomes an integral part of the valve plate 3, that is to say, the thickness of the assembly formed by the valve plate 3 and the base structure 6 does not alter the thickness of an ordinary valve plate, so that there will be no need for other modifications in the compressor 1.

Other embodiments of accommodation of the structure 6, 6 of the support 20 may be provided, the structure 6, 6' being accommodated in a single recess in the valve plate 3 or even in a single recess in the joint 7.

A preferred embodiment having been described, one should understand that the scope of the present invention embraces other possible variations, being limited only by the contents of the accompanying claims, which include the possible equivalents.

The invention claimed is:

1. A support of a proximity sensor of a compressor's piston, the compressor comprising:

a cylinder for the piston;

the cylinder including a valve plate placed at an end of the cylinder to define a border between a high-pressure region inside the cylinder and a low-pressure region outside the cylinder;

the valve plate defining a bore extending from the high-pressure region to the low-pressure region;

the support comprising:

a substantially oblong, planar, and rigid base structure, the base structure extending from a first connection end portion of the base structure to a second connection end portion of the base structure along a surface of the valve plate, the base structure forming a single piece integral with the first connection end portion and the second connection end portion, the first connection end portion and the second connection end portion being in electrical communication with each other through one or more electric interconnections;

the proximity sensor fixed to the first connection end portion of the base structure and configured to extend at least partially through the bore in the valve plate such that at least a first portion of the proximity sensor is positioned inside the high-pressure region of the cylinder in order to detect the piston and at least a second portion of the proximity sensor is accessible from the low-pressure region;

the first connection end portion configured to support the proximity sensor from the low-pressure region and to electrically interconnect the proximity sensor to the second connection end portion, the second connection end portion extends, at least partly, beyond the border of the valve plate.

2. A support according to claim 1, wherein the first connection end portion comprises a supporting means for the proximity sensor.

3. A support according to claim 1, wherein the second connection end portion comprises an electric connector.

4. A support according to claim 1, wherein the base structure comprises at least one pair of electric interconnections.

5. A support according to claim 4, wherein the base structure is manufactured from a printed-circuit plate.

6. A support according to claim 4, wherein the base structure is manufactured from an injected polymer, having at least one guide means for at least one pair of electric conductors.

7. A support according to claim 3, wherein the second connection end portion comprises an electric connection for a calibration resistor, the calibration resistor being electrically connected to the proximity sensor.

8. A support according to claim 2, wherein the supporting means comprises an electric contact for the proximity sensor, the electric contact being provided from a printed-circuit plate.

9. A support according to claim 8, wherein the proximity sensor is an inductive sensor.

10. A support according to claim 7 further comprising, mounted on a single piece, at least one pair of electric interconnections, the proximity sensor, the calibration resistor and the electric connector.

11. A support according to claim 1, wherein the base structure is manufactured from a substantially rigid material.

12. A compressor comprising:

a cylinder, the cylinder includes a valve plate placed at an end of the cylinder to define a border between a high-pressure region inside the cylinder and a low-pressure region outside the cylinder, the valve plate comprising a surface at the low-pressure region and the high-pressure region being hermetically insulated from the low-pressure region by the valve plate and a bore in the valve plate extending from the high-pressure region to the low-pressure region;

a piston positioned inside the cylinder;

a proximity sensor configured to sense the approach of the piston to the valve plate, the proximity sensor extending at least partially through the bore in the valve plate such that at least a first portion of the proximity sensor is positioned inside the high-pressure region of the cylinder in order to sense the piston and at least a second portion of the proximity sensor is accessible from the low-pressure region;

a support comprising a substantially oblong, planar, and rigid base structure, the base structure extending from a first connection end portion to a second connection end portion along the surface of the valve plate, the base structure forming a single piece integral with the first connection end portion and the second connection end portion, the first connection end portion and the second connection end portion being in electrical communication with each other through one or more electric interconnections;

the first connection end portion configured to support the proximity sensor from the low-pressure region and to electrically interconnect the proximity sensor to the second end portion, the proximity sensor fixed to the first connection end portion, the second connection end portion extends, at least partly, beyond the border defined by the valve plate.

13. A compressor according to claim 12 further comprising a cover positioned close to the valve plate and along the border defined by the valve plate.

14. A compressor according to claim 13, wherein the base structure is positioned between the cover and the valve plate.

15. A compressor according to claim 14 further comprising a joint, the joint being positioned between the valve plate and the cover, the base structure being positioned between the cover and the joint.

16. A compressor according to claim 15, wherein the valve plate comprises a guide support for the support.

17. A compressor according to claim 16, wherein the guide support is constituted by a recess in the valve plate.

18. A compressor according to claim 17, wherein the guide support is affected in the alignment of the recess in the valve plate and a recess in the joint.

19. A compressor according to claim 18, wherein the recess in the valve plate has a shape substantially analogous to the base structure.

20. A valve plate for a compressor comprising a guide support for the support as defined in claim 1, the guide support being provided on a surface of the valve plate.

21. A valve plate according to claim 20, wherein the guide support is constituted by a recess in the surface.

22. A valve plate according to claim 21, wherein the recess has a shape substantially analogous to that of the support of the proximity sensor.

* * * * *

UNITED STATES PATENT AND TRADEMARK OFFICE

CERTIFICATE OF CORRECTION

PATENT NO. : 8,628,307 B2
APPLICATION NO. : 10/556254
DATED : January 14, 2014
INVENTOR(S) : Lilie et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1377 days.

Signed and Sealed this
Twenty-second Day of September, 2015

Michelle K. Lee

Michelle K. Lee
*Director of the United States Patent and Trademark Office*